US006260018B1

(12) United States Patent
Imade

(10) Patent No.: US 6,260,018 B1
(45) **Date of Patent: *Jul. 10, 2001**

(54) CODE IMAGE RECORDING APPARATUS HAVING A LOUDSPEAKER AND A PRINTER CONTAINED IN A SAME CABINET

(75) Inventor: Shinichi Imade, Iruma (JP)

(73) Assignee: Olympus Optical Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/162,871

(22) Filed: Sep. 29, 1998

(30) Foreign Application Priority Data

Oct. 9, 1997 (JP) ..... 9-277419

(51) Int. Cl.[7] ..... G10L 11/00
(52) U.S. Cl. ..... 704/276
(58) Field of Search ..... 704/235, 276, 704/270

(56) References Cited

U.S. PATENT DOCUMENTS 5,923,624 * 7/1999 Groeger et al. ..... 369/7
5,970,449 * 10/1999 Alleva et al. ..... 704/235
6,009,393 * 12/1999 Sasaki ..... 704/258
6,043,899 * 3/2000 Morohashi et al. ..... 358/1.18

FOREIGN PATENT DOCUMENTS 0 670 555 A1 9/1995 (EP) .

* cited by examiner

*Primary Examiner*—Richemond Dorvil
*Assistant Examiner*—Angela Armstrong
(74) *Attorney, Agent, or Firm*—Frishauf, Holtz, Goodman, Langer & Chick, P.C.

(57) ABSTRACT

An operation mode control section sets an operation mode flag so as to prohibit any speech replay operation using the loudspeaker when the printer is driven for a printing operation and permits the speech replay operation only after completing the printing operation. When a speech replay/input operation using the loudspeaker is specified by the replay operation section, the operation of the speech output control section is prohibited as the operation mode flag is set to prohibit any speech replay operation using the loudspeaker so that the loudspeaker is held to a standby state until a speech replay operation using the loudspeaker is permitted by the operation mode flag or the operation of the printer is terminated.

5 Claims, 5 Drawing Sheets

| OPERATION MODE FLAG | SPEECH INPUT OPERATION USING MICROPHONE | REPLAY OPERATING USING LOUDSPEAKER | PRINTER OUTPUT OPERATION | |
|---|---|---|---|---|
| 00000001 | AUTHORIZED | UNAUTHORIZED | UNAUTHORIZED | ONLY SPEECH INPUT OPERATION IS ALLOWED BY USING THE BUILT-IN MICROPHONE |
| 00000010 | UNAUTHORIZED | AUTHORIZED | UNAUTHORIZED | ONLY LOUDSPEAKER OUTPUT OPERATION IS ALLOWED |
| 00000100 | UNAUTHORIZED | UNAUTHORIZED | AUTHORIZED | ONLY PRINTER OUTPUT OPERATION IS ALLOWED |
| 00001000 | AUTHORIZED | AUTHORIZED | AUTHORIZED | ALL OPERATIONS ARE ALLOWED |

FIG. 5

CODE IMAGE RECORDING APPARATUS HAVING A LOUDSPEAKER AND A PRINTER CONTAINED IN A SAME CABINET

BACKGROUND OF THE INVENTION

This invention relates to a coder image recording apparatus for recording a speech entered through a microphone by printing it on a predetermined printing medium in the form of an optically readable code image and reproducing the entered speech from a loudspeaker.

The assignee of the present patent application has proposed a recording apparatus for recording speech by printing it on a predetermined printing medium in the form of an optically readable code image of dot codes in EP 0,670,555 A1 (U.S. Ser. No. 08/407,018).

FIGS. 1A and 1B of the accompanying drawings schematically illustrate the configuration of the physical format of dot codes to be used for the proposed recording apparatus. The code pattern 1 comprises a plurality of blocks 2 arranged two-dimensionally on a side by side basis. Each block 2 in turn comprises a data area 3, markers 4 and a block address pattern 5.

The data area 3 contains white dots and black dots representing respective data values of "0s" and "1s" that are assigned to each block as speech data and arranged according to a predetermined format of arrangement to produce a white dot image or a black dot image. The markers 4 are black markers arranged at the four corners of the block 12 to provide a reference point for detecting each dot in the data area 3, each of the markers 4 being formed by a certain number of consecutively arranged black dots. The block address pattern 5 is arranged between adjacently located markers 4 to make the block 2 discriminable from other blocks 2 and contains white dots and black dots representing respective data values of "0s" and "1s" that are assigned to each block as address data including an error detecting or error correcting code. The vertical and horizontal lines connecting the dots in the drawing are used for the ease of understanding and they do not exist in real code images.

A system using dot codes arranged with the above described physical format provides an advantage that the original data can be restored by rearranging the data of the blocks according to their respective addresses if all the dot codes of the data covers an area greater than the area that can be taken by the solid state image sensing device of the image reader or, differently stated, if the entire dot codes of the data cannot be picked up by a single shot, provided that the address of each of the blocks is contained in any of the images taken by the image reader. Therefore, such a dot code system can store a huge volume of data on a single sheet of paper in a matter that can be achieved by no other known one-dimensional or two-dimensional bar code system so that speech data can be transmitted or transported in a simple manner by means of a recording medium such as paper. Thus, the dot code system may have a wide variety of applications that are not conceivable with known code systems.

The code image recording apparatus may be an ordinary printer or a label printer adapted to print and record optically readable dot codes continuously on label-like sheets of paper being fed also continuously along a given direction.

The use of a label printer for a code image recording apparatus is very promising because it is portable and easy to use and hence provides a broad opportunity of utilization.

However, label printers or not, known code image recording apparatuses have problems to be overcome they get a high market value.

More specifically, with a code image recording apparatus of the type under consideration comprising speech input means such as microphone for speech input, code image converting means for encoding the input speech and converting it into a code image of dot codes, a printer for printing and recording the code image obtained by the code image converting means as optically readable image and a loudspeaker for outputting the speech entered by the speech input means, that are contained in a single cabinet, the faint vibrations generated at the time of speech output from the loudspeaker can be transmitted to the printer to interfere with the operation of printing fine dots to deform all or some of the dot codes being printed and adversely affect the operation of reading the printed and recorded dot codes of the code image.

BRIEF SUMMARY OF THE INVENTION

In view of the above identified problem, it is therefore the object of the present invention to provide a code image recording apparatus that can minimize the adverse effect of the vibrations generated at the time of speech output from the loudspeaker on the operation of printing and recording a code image.

According to a first aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, and wherein the speech input means, the code image converting means, the printer and the loudspeaker are all contained in a single cabinet;

operation mode setting (i) means for setting a speech output mode adapted to make the loudspeaker output the speech input by the speech input means, and (ii) a printing/recording mode adapted to make the printer print and record the code image converted by the code image converting means on a printing medium; and mode selection control means for controlling the operation mode setting means so as to set only one of said speech output mode and said printing/recording mode and prohibiting said operation mode setting means to select the other of said modes.

According to a second aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, and wherein the speech input means, the code image converting means, the printer and the loudspeaker are all contained in a single cabinet;

operation mode setting (i) means for setting a speech output mode adapted to make the loudspeaker output the speech input by the speech input means, and (ii) a printing/recording mode adapted to make the printer print and record the code image converted by the code image converting means on a printing medium; and mode selection control means for prohibiting the operation mode setting means to set the printing/recording mode if the operation mode setting means has set the speech output mode.

According to a third aspect of the present invention, there is provided a code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, and wherein the speech input means, the code image converting means, the printer and the loudspeaker are all contained in a single cabinet;

operation mode setting (i) means for setting a speech output mode adapted to make the loudspeaker output the speech input by the speech input means, and (ii) a printing/recording mode adapted to make the printer print and record the code image converted by the code image converting means on a printing medium; and mode selection control means for prohibiting the operation mode setting means to set the speech output mode if the operation mode setting means has selected the printing/recording mode.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention and, together with the general description given above and the detailed description of the preferred embodiment given below, serve to explain the principles of the invention.

FIG. 5 is a chart illustrating operation mode flags to be used for the embodiment of FIG. 2.

DETAILED DESCRIPTION OF THE INVENTION

Now, the present invention will be described by referring to the accompanying drawings that illustrate a preferred embodiment of the invention.

Figure 1A:
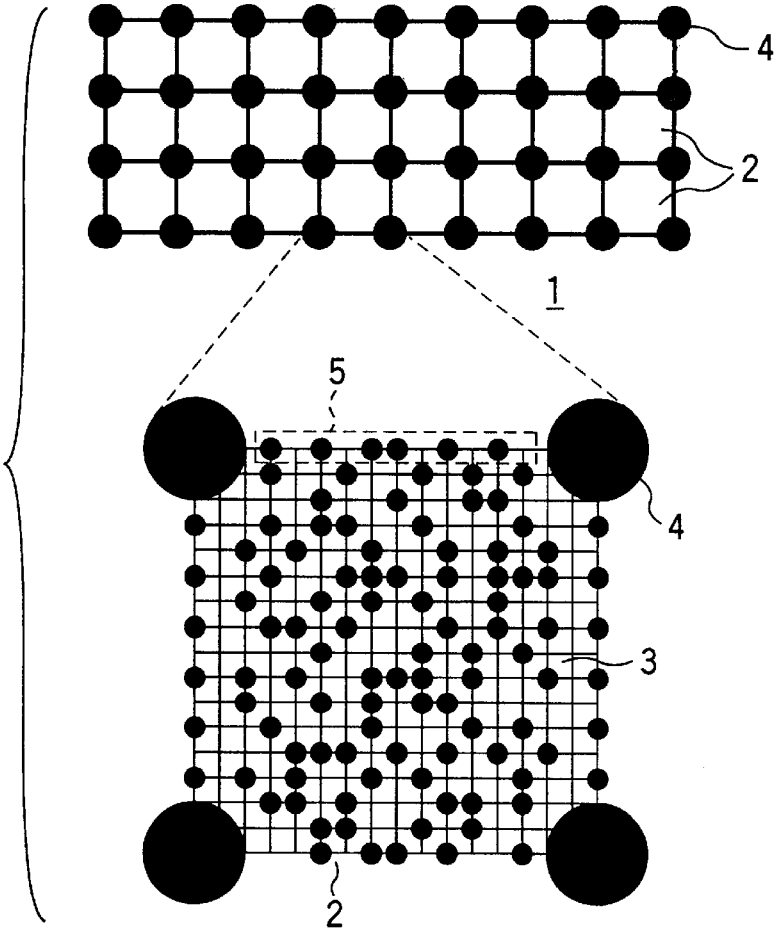
FIG. 1A PRIOR ART
FIG. 1A is a schematic illustration of a physical format of dot codes to be printed on a printing medium for the purpose of the invention.
Figure 1B:
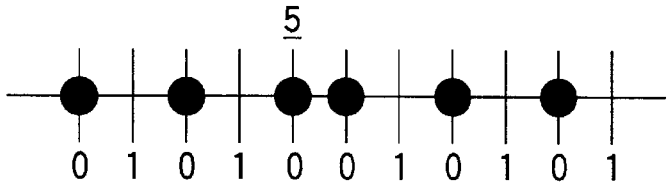
FIG. 1B PRIOR ART
FIG. 1B is a schematic illustration of the block address of the dot code of FIG. 1A.
Figure 2:
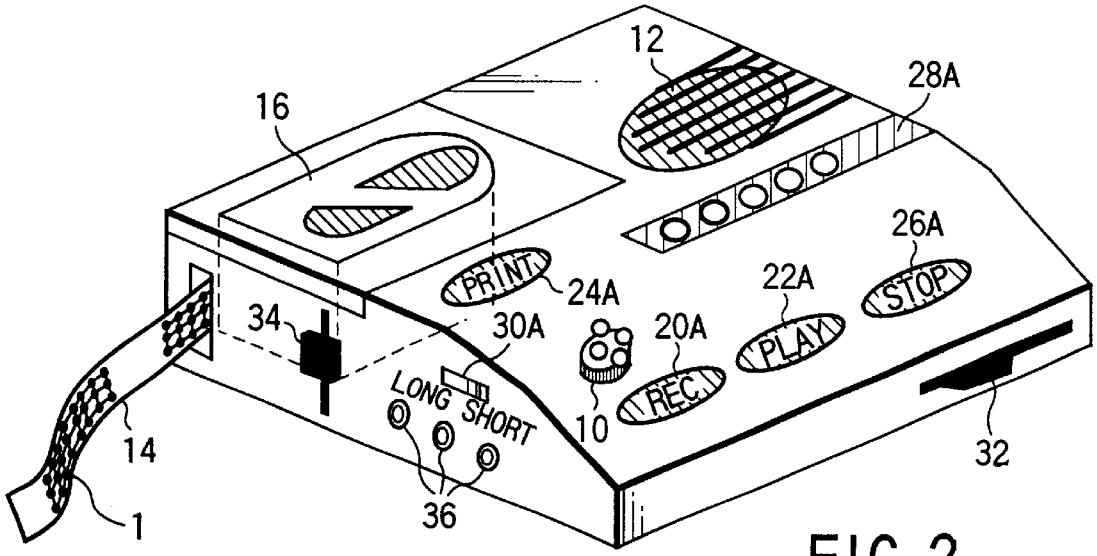
FIG. 2 is a schematic perspective view of an embodiment of code image recording apparatus according to the invention.
Figure 3:
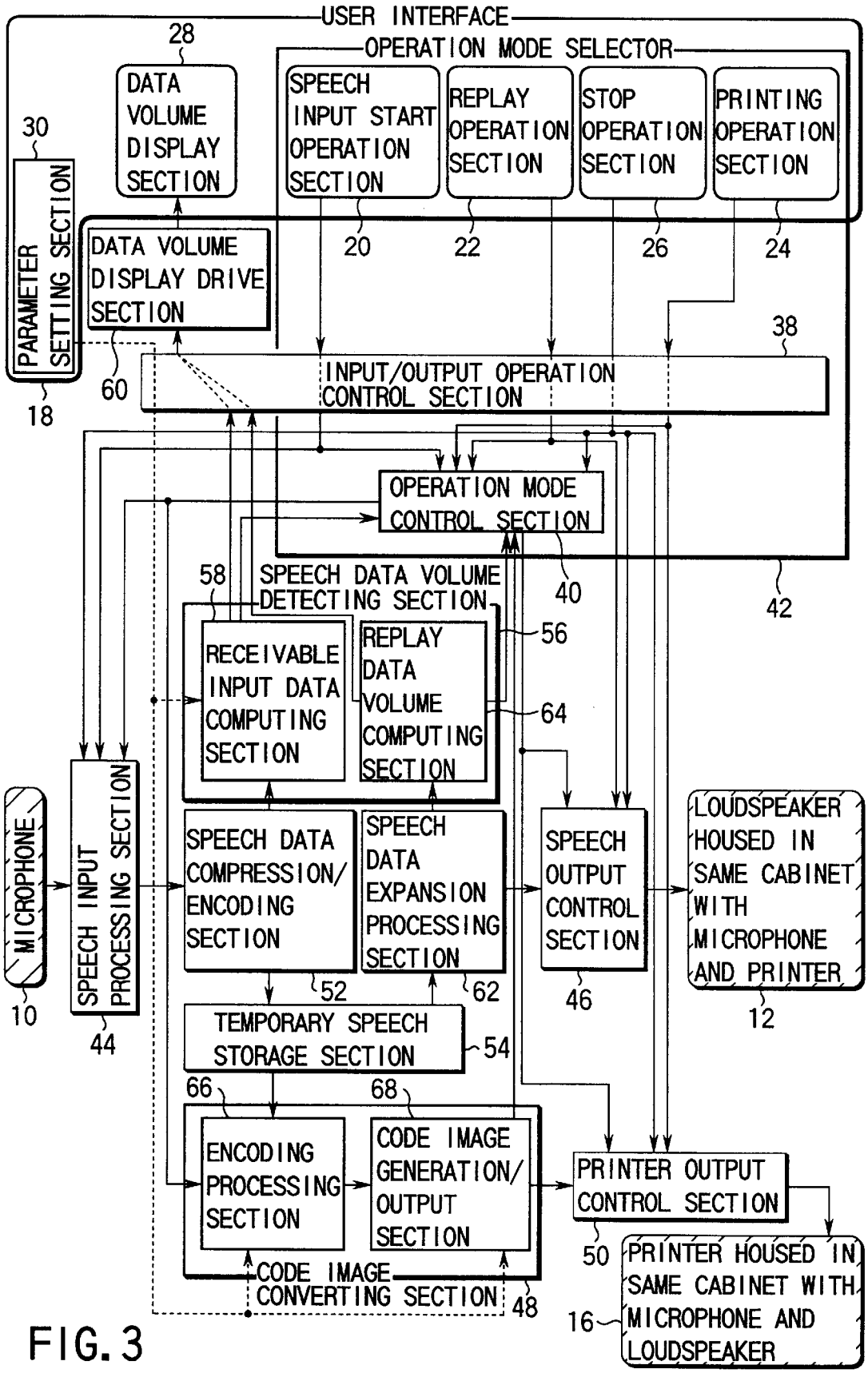
FIG. 3 is a schematic block diagram of the embodiment of code image recording apparatus of FIG. 2.

FIG. 2 is a schematic perspective view of an embodiment of code image recording apparatus according to the invention and FIG. 3 is a schematic block diagram of the embodiment of code image recording apparatus of FIG. 2. The code image recording apparatus comprises a microphone 10 for speech input, a loudspeaker 12 for reproducing the input speech for the purpose of confirmation and a printer 16 for printing a dot code pattern 1 on a label-like printing medium 14, the microphone 10, the loudspeaker 12 and the printer 16 being contained in a single cabinet.

The code image recording apparatus is provided with a speech input start operation section 20, a replay operation section 22, a printing operation section 24, a stop operation section 26, a data volume display section 28 and a parameter setting section 30 arranged on the top and lateral sides of the cabinet.

The speech input start operation section 20 is in fact a "REC" button 20A for starting a speech input operation through the microphone 10 whereas the replay operation section 22 is in fact a "PLAY" button 22A for starting a speech reproducing operation through the loudspeaker 12. The printing operation section 24 and the stop operation section refer respectively to a "PRINT" button 24A for starting an operation of printing a dot code pattern 1 by means of the printer 16 and a "STOP" button 26A for terminating the current operation. The data volume display section 28 is in fact a volume of receivable input/progress of speech reproduction indicator 28A typically comprising five LEDs for indicating the volume of receivable input determined by the preselected total volume of speech input and the volume of input received by microphone 10 and the progress of speech reproduction through the loudspeaker 12.

The parameter setting section 30 includes a long/short mode selector switch 30A for specifying the mode of recording a dot code pattern 1 on a label-like printing medium 14, a total volume of speech input preselecting section and a parameter input section for entering parameters necessary for preparing a dot code pattern 1, although the parameter setting section 30 may alternatively comprise a ROM for storing parameters so that the user may not be required to enter parameters. The long mode and the short mode described above as mode of recording the dot code pattern 1 refer to the respective lengths of the parts to be used when a dot code pattern is divided into a plurality of parts with an interval arranged between any two successive parts so that the dot code pattern may be printed on so many label-like pieces of printing medium 14. For example, the long mode may refer to the use of A4 size (of the A Series Standard used in Japan) sheets of paper arranged vertically and applying label-like sheets of printing medium thereto horizontally, whereas the short mode may refer to the use of blank post cards arranged horizontally (or vertically) and applying label-like sheets of printing medium thereto horizontally.

Reference numeral 32 in FIG. 2 denotes a volume control for controlling the volume with which the input speech is sounded for replaying and reference numeral 34 denotes a cutter lever for operating the built-in cutter to cut and separate the printed label-like sheet of printing medium 14 from the unprinted sheets. Reference numeral 36 denotes a number of jacks to be used for externally inputting/outputting a speech.

The speech input start operation section 20, the replay operation section 22, the printing operation section 24 and the stop operation section 26 operate as part of operation mode selector 42 with an input/output operation control section 38 and an operation mode control section 40. The operation signals from the speech input start operation section 20, the replay operation section 22, the printing operation section 24 and the stop operation section 26 are entered to the operation mode control section 40 by way of the input/output operation control section 38. The operation mode control section 40 controls the operation of each of speech input processing section 44, speech output control section 46, code image converting section 48 and printer output control section 50 according to the present operation mode and the corresponding operation signal it receives as will be described in detail hereinafter.

The speech input control section 44 performs processing operations including amplification, filtering and A/D conversion on the speech signal input through the microphone 10. The speech input processing section 44 is made ready for starting its operation by an operation signal from the speech input start operation section 20 and for stopping its operation by an operation signal from the stop operation section 26, although it does not start its operation until authorized by the operation mode control section 40.

The digital speech data output from the speech input processing section 44 is compressed/encoded for every speech frame unit of 30 msec by a speech data compression/encoding section 52 and stored in a temporary data storage section 54. Speech data volume detecting section 56 has a receivable input data computing section 58 that computes the speech volume that can still be input into the recording apparatus on the basis of the number of frames compressed by the speech data compression/encoding section 52 and the number of frames corresponding to the total speech volume to be input set by the parameter setting section 30 and sends the outcome of the computation to a data volume display drive section 60 by way of the input/output operation control section 38. The data volume display drive section 60 energize the five LEDs of the volume of receivable input/progress of speech reproduction indicator 28A to display the speech volume that can still be received by the recording apparatus.

The speech output control section 46 performs processing operations including amplification, filtering and D/A conversion on the speech data to be reproduced from the loudspeaker 12. The speech output control section 46 is made ready for starting its operation by an operation signal from the replay operation section 22 and stopping its operation by an operation signal from the stop operation section 26, although it does not start its operation until authorized by the operation mode control section 40.

The speech data sent to the speech output control section 46 is a data obtained by expanding the compressed/encoded data stored in the temporary data storage section 54 by means of a speech data expansion processing section 62. At this time, a data indicating the number of frames subjected to the expansion processing operation of the speech data expansion processing section 62 is fed to replay data volume computing section 64 of the speech data volume detecting section 56 from the speech data expansion processing section 62. The replay data volume computing section 64 determines by computation the volume of data reproduced from data stored in the temporary data storage section 54. The outcome of the computing operation is then fed to the data volume display drive section 60 by way of the input/output operation control section 38 so that the progress of speech reproduction is indicated as the five LEDs of the volume of receivable input/progress of speech reproduction indicator 28A are energized.

The printer output control section 50 controls the printer 16 to print the code image of the dot codes converted by the code image converting section 48. The printer output control section 50 is made ready for starting its operation by an operation signal from the printing operation section 24 and stopping its operation by an operation signal from the stop operation section 26, although it does not start its operation until authorized by the operation mode control section 40.

The code image converting section 48 that feed the printer output control section 50 with a code image of dot codes comprises an encoding processing section 66 for encoding compressed/encoded speech data stored in the temporary data storage section 54 and a code image generation/output section 68 for converting coded data into a code image and outputting the generated code image. The operation of the encoding processing section 66 is controlled by the operation mode control section 40. Parameters including the compression ratio, the resolution, the number of block rows and the length of the parts obtained by dividing the dot codes necessary for encoding and outputting a code image are set by means of the parameter setting section 30.

The code image generation/output section 68 has a memory (not shown) for storing the generated code image so that a same dot code pattern 1 can be duplicatively reproduced simply by operating the printing operation section 24.

Now, the operation of the embodiment of code image recording apparatus having the above described configuration will be described below.

Figure 4:
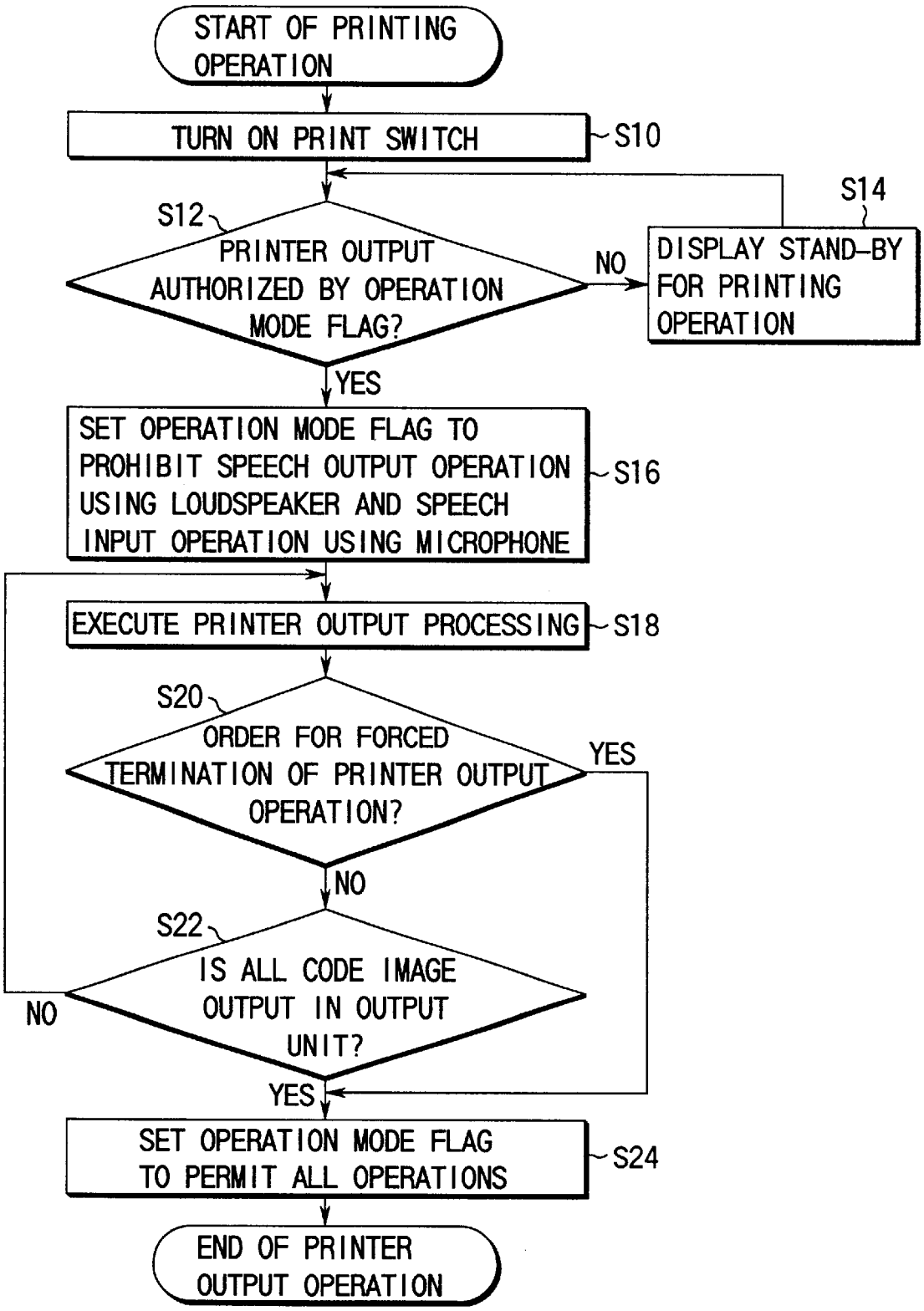
FIG. 4 is a flow chart of the printing operation of the embodiment of FIG. 2.

FIG. 4 is a flow chart of the printing operation of the embodiment. It is assumed here that the speech entered through the microphone 10 has been compressed and encoded and the operation of encoding data and generating a code image has been completed.

As the "PRINT" button 24A of the printing operation section 24 is depressed (Step S10), the operation mode control section 40 reads the current status of the operation mode flag and determines if a printer output operation is permitted or not (Step S12). As shown in FIG. 5, the operation mode flag is a 8-bit data, where bit "1" indicates if a speech input operation using the built-in microphone 10 is permitted or not and bit "2" indicates if a speech output operation using the loudspeaker 12 is permitted or not, whereas bit "3" indicates if an operation of printing the dot code pattern 1 that corresponds to the input speech on the label-like recording medium by means of the printer 16 is permitted or not and bit "4" indicates if the overall operation of the code image recording apparatus is authorized or not. Thus, "00000001" indicates a state where only a speech input operation using the microphone 10 is authorized and "00000010" indicates a state where only a speech reproducing operation using the loudspeaker 12 is authorized, whereas "00000100" indicates a state where only an operation of printing a dot code pattern by means of the printer 16 is authorized and "00001000" indicates a states where all the above operations are authorized and can be conducted simultaneously.

In an operation mode where no printer output operation is authorized, the stand-by state is typically displayed to the user in the form of an error message (not shown) (Step S14) and the processing operation returns to Step S12. Thus, if mechanical vibrations occur as the loudspeaker 12 is driven to operate, the printing operation of the printer 16 would not be affected because the printer is not operated while the loudspeaker 12 is replaying a speech.

On the other hand, in an operation mode where a printer output operation is authorized, the operation mode flag is set to "00000100" to prohibit any speech output from the loudspeaker 12 and any speech input operation through the microphone 10 (Step S16). Thus, the speech output control section 46 is not driven to generate mechanical vibrations that adversely affect the printing operation of the printer 16 while the printer 16 is in operation.

The operation mode control section 40 authorizes the printer output control section 50 to carry out a printer output processing operation of printing a code image of dot codes sent from the code image converting section 48 on a label-like printing medium 14 by means of the printer 26 (Step S18).

The operation mode control section 40 checks if an order for forced termination of printer output operation is given by the user by depressing the "STOP" button 26A of the stop operation section 26 during the printer output processing operation (Step S20) and, if such an order is given, it proceeds to Step S24, which will be discussed hereinafter. If an order for forced termination of printer output operation is not given, it determines if all the code image expressed in terms of output unit and generated by the code image generation/output section 68 has been output or not (Step S22) and returns to Step S18 if all the code image has not been output.

If, on the other hand, it is found that all the code image expressed in terms of output unit has been output, the operation mode control section 40 sets the operation mode flag to "00001000" to indicate that all intended operations of the code image recording apparatus are authorized (Step S24) before terminating the current printing operation.

Figure 6:
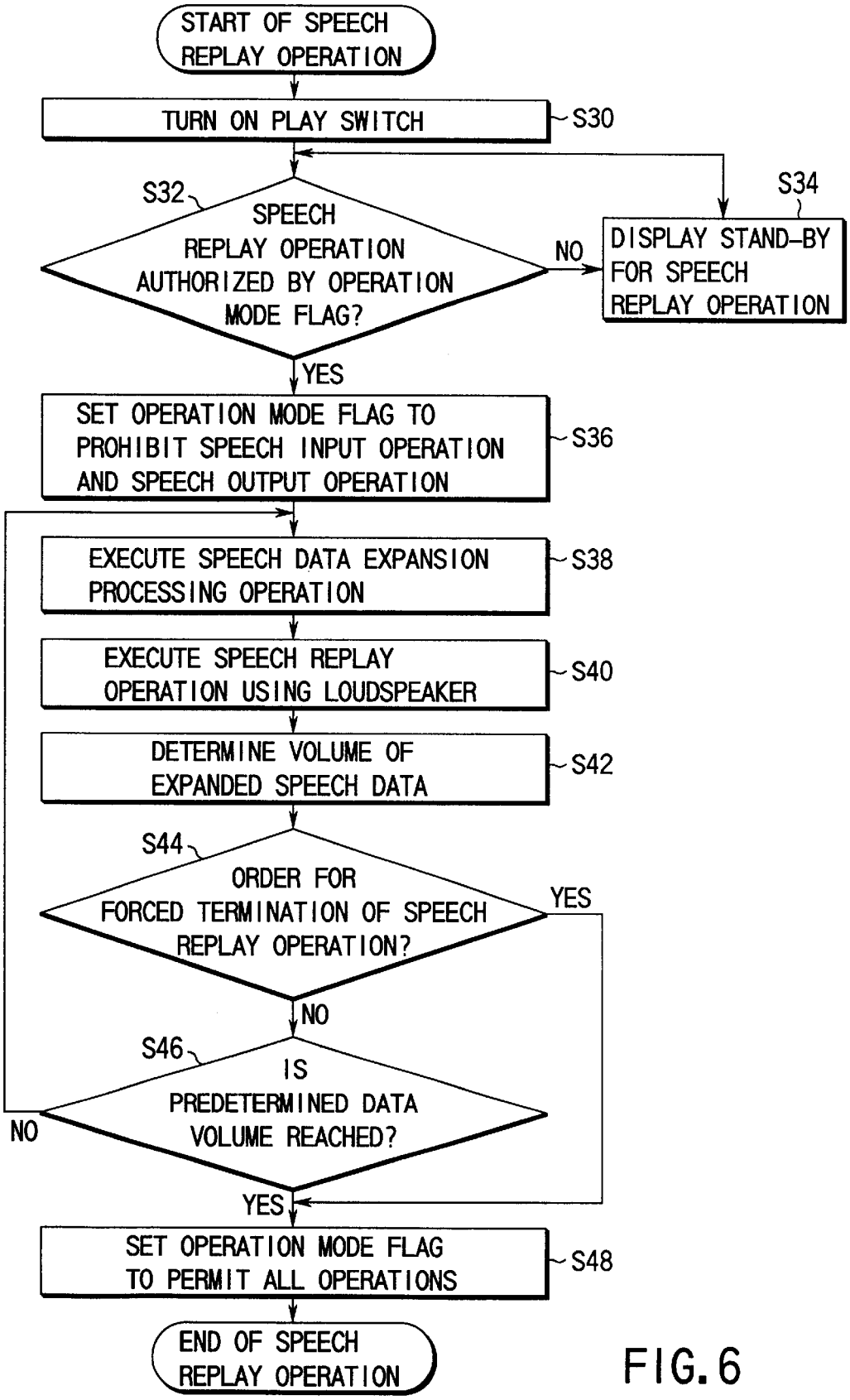
FIG. 6 is a flow chart of the speech output operation of the loudspeaker.

FIG. 6 is a flow chart of the speech replay operation of the loudspeaker 12. It is assumed here that the speech entered through the microphone 10 has been compressed/encoded and stored in the temporary storage section 54.

More specifically, as the "PLAY" button 22A of the replay operation section 22 is depressed (Step S30), the operation mode control section 40 reads the operation mode flag and determines if a replay operation using the loudspeaker 12 is permitted or not (Step S32). If the operation mode flag shows that the replay operation using the loudspeaker 12 is not permitted, the stand-by state is typically displayed to the user in the form of an error message (not shown) (Step S34) and the processing operation returns to Step S32. Thus, the speech output control section 46 is not driven while the printer 16 is in operation so that no mechanical vibration is generated by the loudspeaker 12 to adversely affect the printing operation of the printer 16 because the loudspeaker 12 is not driven.

On the other hand, in an operation mode where a replay operation using the loudspeaker 12 is authorized, the operation mode flag is set to "00000010" to prohibit any speech input operation using the microphone 10 and any printing output operation of the printer 16 (Step S36). Thus, the printer 16 is held to a stand-by state when a speech replay operation is in progress at the loudspeaker 12 so that the printing operation of the printer 16 would not be adversely affected if mechanical vibrations are generated by the loudspeaker 12 that is driven.

The operation mode control section 40 authorizes the speech output control section 46 to operate and cause the speech data expansion processing section 62 to expand the compressed and encoded speech data stored in the temporary data storage section 54 (Step S38) and the loudspeaker 12 to output the obtained speech (Step S40). The replay volume computation section 64 determines by computation the volume of speech data expanded by the speech data expansion processing section 62 and causes the data volume display drive section 60 to make the volume of receivable input/progress of speech reproduction indicator 28A of the data volume display section 28 display the progress of the relay operation (Step S42).

The operation mode control section 40 checks if an order for forced termination of speech replay operation is given by the user by depressing the "STOP" button 26A of the stop operation section 26 during the speech replay operation (Step S44) and, if such an order is given, it proceeds to Step S48, which will be discussed hereinafter. If an order for forced termination of speech replay operation is not given, it determines if the volume of speech already output has got to the level corresponding to the input data volume preselected by the parameter setting section 30 or not on the basis of the outcome of the computation of the replay volume computation section 64 (Step S46) and returns to Step S38 if the volume of speech already output has not got to that level.

If, on the other hand, it is found that the volume of speech already output has reached the level corresponding to the input data volume, the operation mode control section 40 sets the operation mode flag to "00001000" to indicate that all intended operations of the code image recording apparatus are authorized (Step S48) before terminating the replay operation using the loudspeaker 12.

Thus, as described above in detail, a speech replay operation of the loudspeaker 12 and a code image printing operation of the printer 16 do not take place concurrently with a code image recording apparatus according to the invention so that the risk of degrading the quality of the operation of printing and recording a code image due to the vibrations generated as a speech is output from the loudspeaker 12 can be minimized.

While the present invention is described above by referring to a preferred embodiment, the present invention is not limited thereto and the above embodiment can be altered or modified in many different ways without departing from the scope of the invention.

The present invention may be summarized as follows.

(1) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, and wherein the speech input means, the code image converting means, the printer and the loudspeaker are all contained in a single cabinet;

operation mode setting means for setting a (i) speech output mode adapted to make the loudspeaker output the speech input by the speech input means and (ii) a printing/recording mode adapted to make the printer print and record the code image converted by the code image converting means on a printing medium; and mode selection control means for controlling the operation mode setting means so as to set only one of said speech output mode and said printing recording mode and prohibiting said operation mode setting means to select the other of said modes.

With the above arrangement, the mode selection feature is so controlled that both the printing/recording mode and the speech output mode would not be set concurrently to ensure that the printer can successfully print the code image of densely populated fine dots to an enhanced level of quality.

(2) A code image recording apparatus comprising:

speech input means for inputting a speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, and wherein the speech input means, the code image converting means, the printer and the loudspeaker are all contained in a single cabinet;

operation mode setting (i) means for setting a speech output mode adapted to make the loudspeaker output the speech input by the speech input means and (ii) a printing/recording mode adapted to make the printer print and record the code image converted by the code image converting means on a printing medium; and mode selection control means for prohibiting the operation mode setting means to set the printing/recording mode if said operation mode setting means has set the speech output mode.

With the above arrangement of the code image recording apparatus comprising the speech input means, the loudspeaker output means for confirming the speech input by replaying it and the printer for printing/recording the code image converted from the confirmed speech on the recording medium contained in the single cabinet, when the speech output operation mode has priority, any undesired vibrations that can adverse affect the printer should be preventing from entering the printer in order to ensure that the printer can successfully print the code image of densely populated fine dots to an enhanced level of quality. Particularly, in view of the fact that the acoustic vibrations generated by the speech output operation of the loudspeaker provide the largest cause of trouble, any mechanical vibrations produced by the loudspeaker being driven can be prevented from adversely affecting the printing operation of the printer simply by prohibiting the selection of a printing/recording mode for driving the printer when a speech output mode is selected or when a speech output operation is authorized. Additionally, the vibration absorbing measures that may be absolutely required when the printer is driven to operate during a speech output operation will not be necessary to consequently reduced the cost of the code image recording apparatus.

(3) An apparatus according to (2), further comprising:

speech data volume detecting means for detecting volume of the speech data of the speech output in the speech output mode, and determining if the detected volume is short of a predetermined data volume or not, and wherein:

the mode selection control means releases the set speech output mode to allow the operation mode setting means to set a printing/recording mode when the speech data volume detecting means determines that the detected output speech data volume has got to the predetermined data volume.

With a code image recording apparatus comprising speech input means, loudspeaker output means and a printer contained in a single cabinet, the speech output operation may be temporarily suspended so that the output of the speech is reflected only by the volume of the speech data stored in the apparatus. Additionally, any undesired vibrations that can adversely affect the printer should be prevented from entering the printer in order to ensure that the printer can successfully print a code image of densely populated fine dots to an enhanced level of quality. Therefore, the duration of the speech output operation can be determined for certain by detecting the volume of the stored speech data and determining if the volume has got to the preselected volume level so that the printing/recording operation mode and hence the operation of driving the printer may be prohibited reliably for that duration. Thus, any mechanical vibrations produced by the loudspeaker being driven can be prevented from adversely affecting the printing operation of the printer simply by prohibiting the selection of a printing/recording mode for driving the printer. Additionally, the vibration absorbing measures that may be absolutely required when the printer is driven to operate during a speech output operation will not be necessary to consequently reduced the cost of the code image recording apparatus.

(4) A code image recording apparatus comprising:

speech input means for inputting speech;

code image converting means for converting the speech input by the speech input means into a code image of encoded data arranged according to a predetermined format;

a printer for printing the code image converted by the code image converting means on a predetermined printing medium as an optically readable image;

a loudspeaker for outputting the speech input by the speech input means, wherein the speech input means, the code image converting means, the printer and the loudspeaker are all contained in a single cabinet;

operation mode setting means for setting a (i) speech output mode adapted to make the loudspeaker output the speech input by the speech input mean, and (ii) a printing/recording mode adapted to make the printer print and record the code image converted by the code image converting means on a printing medium; and mode selection control means for prohibiting the operation mode setting means to set the speech output mode if the operation mode setting means has set the printing/recording mode.

With a code image recording apparatus comprising speech input means, loudspeaker output means for confirming the speech input by replaying it and a printer for printing/recording a code image converted from the confirmed speech on a recording medium contained in a single cabinet, any undesired vibrations that can adversely affect the printer should be prevented from entering the printer in order to ensure that the printer can successfully print a code image of densely populated fine dots to an enhanced level of quality when the printing/recording mode has priority. Particularly, in view of the fact that the acoustic vibrations generated by the speech output operation of the loudspeaker provide the largest cause of trouble, any mechanical vibrations produced by the loudspeaker being driven can be prevented from adversely affecting the printing operation of the printer to realize a high printing quality simply by prohibiting the selection of a speech output operation mode for driving the loudspeaker when a printing/recording mode is selected or when a printing/recording operation is authorized. Additionally, the vibration absorbing measures that may be absolutely required for the printer when the loudspeaker is authorized to operate during a printing/recording operation will not be necessary to consequently reduced the cost of the code image recording apparatus.

(5) An apparatus according to (4), further comprising:

code image volume detecting means for detecting the volume of the code image printed and recorded in the printing/recording mode and determining if the detected volume is short of a predetermined volume or not, and wherein:

the mode selection control means releases the set printing/recording mode to allow the operation mode setting means to set a speech output mode when the code image volume detecting means determines that the volume of the printed and recorded code image has got to the predetermined data volume.

With a code image recording apparatus comprising speech input means, loudspeaker output means and a printer contained in a single cabinet, the code image printing/recording operation may be temporarily suspended so that the volume of the code image printed and recorded by the printer is reflected only by the volume of the code image stored in the apparatus. Additionally, any undesired vibrations that can adversely affect the printer should be prevented from entering the printer in order to ensure that the printer can successfully print a code image of densely populated fine dots to an enhanced level of quality. Therefore, the duration of the code image printing operation can be determined for certain by detecting the volume of data of the code image and determining if the volume has got to the preselected volume level so that the operation of driving the loudspeaker may be prohibited reliably for that duration. Thus, any mechanical vibrations produced by the loudspeaker being driven can be prevented from adversely affecting the printing operation of the printer to realize a high printing quality simply by prohibiting the selection of a speech output operation mode for driving the loudspeaker. Still additionally, the vibration absorbing measures that may be absolutely required for the printer when the loudspeaker is authorized to operate during a printing/recording operation will not be necessary to consequently reduced the cost of the code image recording apparatus.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

a loudspeaker for outputting the speech input by said speech input means, and wherein said speech input means, said code image converting means, said printer and said loudspeaker are all contained in a single cabinet;

operation mode setting means for setting (i) a speech output mode adapted to make said loudspeaker output the speech input by said speech input means, and (ii) a printing/recording mode adapted to make said printer print and record the code image converted by said code image converting means on a printing medium; and mode selection control means for controlling said operation mode setting means so as to set only one of said speech output mode and said printing/recording mode and prohibiting said operation mode setting means to set the other of said modes.

2. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

a loudspeaker for outputting the speech input by said speech input means, and wherein said speech input means, said code image converting means, said printer and said loudspeaker are all contained in a single cabinet;

operation mode setting means for setting (i) a speech output mode adapted to make said loudspeaker output the speech input by said speech input means, and (ii) a printing/recording mode adapted to make said printer print and record the code image converted by said code image converting means on a printing medium; and mode selection control means for prohibiting said operation mode setting means to set the printing/recording mode if said operation mode setting means has set the speech output mode.

3. An apparatus according to claim 2, further comprising:

speech data volume detecting means for detecting the volume of speech data of the speech output in the speech output mode, and determining if the detected volume is short of a predetermined data volume or not, and wherein:

said mode selection control means releases the set speech output mode to allow said operation mode setting means to set the printing/recording mode when said speech data volume detecting means determines that the detected output speech data volume has got to the predetermined data volume.

4. A code image recording apparatus comprising:

speech input means for inputting speech;

code image converting means for converting the speech input by said speech input means into a code image of encoded data arranged according to a predetermined format;

a printer for printing the code image converted by said code image converting means on a predetermined printing medium as an optically readable image;

a loudspeaker for outputting the speech input by said speech input means, and wherein said speech input means, said code image converting means, said printer and said loudspeaker are all contained in a single cabinet;

operation mode setting means for setting (i) a speech output mode adapted to make said loudspeaker output the speech input by said speech input means, and (ii) a printing/recording mode adapted to make said printer print and record the code image converted by said code image converting means on a printing medium; and mode selection control means for prohibiting said operation mode setting means to set the speech output mode if the operation mode setting means has set the printing/recording mode.

5. An apparatus according to claim 4, further comprising:

code image volume detecting means for detecting the volume of the code image printed and recorded in the printing/recording mode and determining if the detected volume is short of a predetermined volume or not, and wherein:

said mode selection control means releases the set printing/recording mode to allow said operation mode setting means to set the speech output mode when said code image volume detecting means determines that the printed and recorded code image volume has got to the predetermined data volume.

* * * * *